US011419788B2

(12) United States Patent
Sohler et al.

(10) Patent No.: US 11,419,788 B2
(45) Date of Patent: Aug. 23, 2022

(54) MEDICAL PACKAGING SLEEVE HAVING A TAMPER-EVIDENT CAP AND A MOUNTING SECURING MECHANISM FOR STERILE USE

(71) Applicants: Wolfgang Sohler, Wangen-Neuravensburg (DE); Thiemo Roesler, Wangen (DE)

(72) Inventors: Wolfgang Sohler, Wangen-Neuravensburg (DE); Thiemo Roesler, Wangen (DE)

(73) Assignee: Roesler IP GmbH

( * ) Notice: Subject to any disclaimer, the term of this patent is extended or adjusted under 35 U.S.C. 154(b) by 62 days.

(21) Appl. No.: 16/579,114

(22) Filed: Sep. 23, 2019

(65) Prior Publication Data

US 2020/0093689 A1 Mar. 26, 2020

(30) Foreign Application Priority Data

Sep. 24, 2018 (DE) ..... 102018123372.8

(51) Int. Cl.
*A61J 1/00* (2006.01)
*B65D 55/02* (2006.01)

(52) U.S. Cl.
CPC ..... *A61J 1/00* (2013.01); *B65D 55/02* (2013.01)

(58) Field of Classification Search
CPC ..... A61J 1/03; A61J 1/1412; A61J 1/1437; A61J 1/00; A61J 1/14; A61J 1/1418; A61J 1/18; B65D 55/02
See application file for complete search history.

(56) References Cited

U.S. PATENT DOCUMENTS

| | | | | |
|---|---|---|---|---|
| 4,945,708 | A * | 8/1990 | Curiel | B65D 55/02 53/411 |
| 5,738,231 | A * | 4/1998 | Montgomery | B65D 55/02 215/230 |
| 6,152,316 | A | 11/2000 | Niese | |
| 2011/0015578 | A1* | 1/2011 | Lowke | A61M 5/5086 604/192 |
| 2017/0095308 | A1* | 4/2017 | Roesler | A61C 8/0087 |

FOREIGN PATENT DOCUMENTS

| | | |
|---|---|---|
| DE | 29501421 | 5/1995 |
| DE | 20122105 | 4/2004 |

* cited by examiner

*Primary Examiner* — Javier A Pagan
(74) *Attorney, Agent, or Firm* — Dentons Cohen & Grigsby P.C.

(57) ABSTRACT

Medical packaging sleeve having a tamper-evident cap for sterile use consisting of an approximately cylindrical sleeve body which is open on one side and the opening of which can be tightly sealed by a sealing stopper, wherein the position of the sealing stopper can be fixed with an approximately sleeve-shaped tamper-evident cap which extends over the sealing stopper, wherein the tamper-evident cap can be snapped onto the sleeve body, wherein the sealing stopper can be screwed into the opening of the sleeve body with a threaded screw connection, and there is a visual inspection to check the sealed rotational position between the sealing stopper and the sleeve body, wherein the tamper-evident cap is non-rotatably connected to the sealing stopper and can be engaged with the sleeve body only in the sealed rotational position of the sealing stopper.

20 Claims, 11 Drawing Sheets

(securing position)
visual part.
(securing position)
mechanical

Incorrect position visual

Incorrect position mechanical

Incorrect position mechanical

Securing position

Securing position

Control chain

| | | |
|---|---|---|
| 44 | betw. 1 & 5 | (visual) Rotational position of 5 |
| ↓ | | |
| 45 | betw. 1 & 5 | (mechanical) Rotational position of 5 |
| ↓ | | |
| 46 | betw. 20;30 & 1 | (mechanical) Rotational position of 20 & 30 |

MEDICAL PACKAGING SLEEVE HAVING A TAMPER-EVIDENT CAP AND A MOUNTING SECURING MECHANISM FOR STERILE USE

CROSS REFERENCE TO RELATED APPLICATIONS

The present application claims the benefit under 35 U.S.C. § 119(e) of German Application No. 102018123372.8, filed Sep. 24, 2018, which is hereby incorporated by reference herein in its entirety.

FIELD OF THE INVENTION

The subject matter of the invention is a medical packaging sleeve having a tamper-evident cap for sterile use.

BACKGROUND OF THE INVENTION

A medical packaging sleeve of a general type has become known with the subject matter of EP 1 055 609 B1, for example, in which a closure cap provided with an internal thread is screwed onto the external thread of a packaging sleeve or packaging bottle, and a strip which can be separated from the cap by means of a thinned portion is formed on the underside of the cap and, in connection with a pull tab, makes it possible for the cap to be twisted off the packaging sleeve or the packaging bottle when the pull tab is torn open.

This type of known medical sleeve packaging has the disadvantage that the sealing connection between the cover, which is secured by a tamper-evident cap, and the packaging sleeve does not seal reliably, because the sealing ring lacks the appropriate pre-tensioning.

A further disadvantage of the known sleeve packaging is that there is no control of the sealing connection between the screw-on cap and the sleeve body of the packaging sleeve. Therefore, it cannot be checked whether the screw cap is properly screwed onto the packaging body in a tightly sealing manner.

Another disadvantage is that the sealing surface is only arranged axially on the inside of the closure cap and therefore also cannot be checked visually. A radial arrangement of such a sealing surface cannot be found in this document.

In the case of a sealing test when using at least partially transparent materials, however, the arrangement of a radial sealing surface would have the advantage that the failure of the respective seal could be demonstrated, which, due to the arrangement of the seal used, is not possible for the subject matter of EP 1 055 609 B1.

Another disadvantage of the known arrangement is that the tamper-evident cap forms a single one-piece part with the cover and that, for this reason, the functions of the cover and its sealing closure in connection with the tamper-evident cap are not separate.

It is therefore not possible to screw or push a cover tightly onto a closing body with a first control and check the sealing effect and only use a tamper-evident cap in a second step which fixes this sealed rotational position of the cover and preserves it unchangeably. All of these features cannot be found in the mentioned document.

Another medical sleeve packaging with a mounting securing mechanism, in which the packaging body is first closed with a rubber stopper and the rubber stopper placed on the packaging body in a sealing manner is fixed with a sleeve-like tamper-evident cap, has become known with the subject matter of WO 2009/109312 A1. The tamper-evident cap is used to close a syringe barrel in a sterile manner. The syringe barrel has a lockable cone connection in the form of an outer cone having an engageable internal thread adapter. The outer cone is closed with a rubber stopper. The tamper-evident cap is placed over the rubber stopper and a safety cap.

This is a two-part tamper-evident cap, in which an upper sleeve part can be separated from a lower sleeve part, wherein the connection between the two sleeve parts is not formed by a circumferential tear-off strip, but by connecting knobs having a reduced cross section.

The mentioned document thus relates to a tamper-evident cap for a container or a syringe having a lockable cone adapter which is closed in a sterile manner by means of a rubber stopper and is secured by a safety sleeve, wherein the safety sleeve, which is non-releasably pushed onto the cone adapter lock, consists of a retaining part, a break-off part and a break-off zone positioned between said parts.

The disadvantage is that the sealing position and the sealing function of the used rubber stopper in the closing sleeve cannot be checked. It is also not a screwed seal but a plug-in seal, so that the rubber stopper should rest against the inner surface of a neck-shaped base in the closing sleeve with external sealing ribs.

It is furthermore known from this document that the two-part tamper-evident cap can be snapped onto an associated latching edge on the packaging sleeve with a lower latching collar at its bottom open end, by means of which the displacement position of the rubber stopper in the packaging sleeve is checked at the same time.

The closing position of the used rubber stopper can therefore only be checked via the ability of the two-part tamper-evident cap to snap on. A special visual inspection or a mechanical securing of the position between the sealing stopper and the packaging sleeve is not provided.

A mechanical securing of the position of the sealing stopper by checking said position on the packaging sleeve cannot be found in this document.

Deformed sealing stoppers may therefore not achieve the desired sealing effect. In any case, an improved sealing effect for medical sleeve packagings should be achieved by means of threaded connections that can be screwed into one another. Therefore a push sealing connection is not sufficiently secure, especially if a medical sleeve packaging is intended to be double-sterile.

There is moreover the further disadvantage that the mentioned medical sleeve packaging is only functional if the tamper-evident cap is used as well, because only said cap makes the securing of the position of the push or plug stopper possible.

An elimination of the tamper-evident cap would render the mentioned packaging unusable.

The mentioned document is also not able to transmit a specific rotational, inserted or sealing position of the sealing stopper or a specific closing position onto the tamper-evident cap and, based on that, provide a securing of the position which ensures that the tamper-evident cap is securely connected to the stopper in the proper position.

SUMMARY OF THE INVENTION

Consequently, based on WO 2009/109312 A1, the underlying object of the invention is to further develop a medical sleeve packaging having a tamper-evident cap in such a way that a mounting securing mechanism for securing and checking the sealing effect is additionally provided.

A preferred feature of the invention is therefore that, with the technical features of a medical packaging sleeve sealable by a sealing stopper, the arrangement of a tamper-evident cap now makes it possible to visually and/or mechanically check whether the sealing stopper is mounted in the packaging sleeve in a positionally secured and sealed manner.

According to a further preferred feature, it can mechanically and/or visually be checked whether the rotational position, in particular the sealing position, of the sealing stopper in the packaging sleeve is sealed and in the proper position.

Therefore, in a preferred design, the invention provides that a tamper-evident cap is non-rotatably connected to the sealing stopper, so that the rotational and sealing position of the sealing stopper can be checked.

According to a first embodiment of the present invention, therefore, the sealing stopper is screwed into the packaging sleeve as a threaded sealing connection and forms a first sealing surface there.

It is preferred if the arrangement of this sealing surface is controllable; the invention provides the necessary design features to do this.

A preferred embodiment includes a control chain with successive steps, wherein the rotational position between the sealing stopper and the packaging sleeve is preferably provided by means of a visual seal check, so that, independent of the arrangement of a tamper-evident cap, it can be checked whether the sealing stopper provided with a threaded sealing connection is sealingly screwed onto the packaging sleeve in the proper position. The first sealing surface between the sealing stopper and the packaging sleeve is thus checked by means of the mentioned visual inspection.

In a further development of the invention, it can be provided that the end position between the sealing stopper and the packaging sleeve can additionally be checked by means of a mechanical, haptically perceptible latching position, which, however, must only be present in special cases. In other cases, it can be provided that this mechanical latching position is omitted, so that a perceptible attainment of the end position between sealing stopper and packaging sleeve can be omitted as well.

Based on the first mentioned visual and/or mechanical control of the rotational position between the sealing stopper and the packaging sleeve, a feature of the invention provides that the checked sealing rotational position of the sealing stopper with the packaging sleeve is transmitted to the separately placeable tamper-evident cap.

According to a preferred feature, it is therefore provided that the sealing stopper is non-rotatably connected to the tamper-evident cap, which can, for example, be achieved by the fact that a manually actuatable toggle is attached to the closure stopper and engages non-rotatably in an associated receiving opening on the inside of the tamper-evident cap or in a slot opening, in order to thus bring about a non-rotatable connection between the tamper-evident cap and the sealing stopper.

There is thus the advantage that, due to the aforementioned control function, first the positionally secured closing positionally secured of the sealing stopper is transmitted to the tamper-evident cap with the visual and/or mechanical control of the rotational and sealing position between the sealing stopper and the packaging sleeve, and, in a further development of the invention, it is provided that the tamper-evident cap can now be pushed onto and engaged with the packaging sleeve only when the aforementioned secured rotational connection between the packaging sleeve and the sealing stopper has been achieved. If this is not achieved, the tamper-evident cap also cannot be snapped onto the packaging sleeve as a sleeve part.

According to a further preferred feature, this is achieved in that at least one axially projecting centering lug, which can be brought into alignment with an associated upwardly open latching groove disposed on the periphery of the packaging sleeve, is disposed on the lower sleeve part of the tamper-evident cap.

Only when the at least one centering lug on the lower edge of the tamper-evident cap engages in the latching groove disposed on the periphery of the packaging sleeve can the tamper-evident cap be snapped onto the packaging sleeve.

This is therefore a rotational position-encoded key connection between the packaging sleeve and the tamper-evident cap, which ensures that the tamper-evident cap can only be snapped onto the packaging sleeve if it is in a specific rotational position relative to said packaging sleeve.

Instead of this type of key position with a centering lug that is disposed on the tamper-evident cap and that can be engaged in an associated latching groove on the outer periphery of the packaging sleeve, there are also other key associations.

In another embodiment, which is configured as a kinematic inversion of the first design, it can be provided that such a centering lug, which cooperates with an associated latching groove on the outer periphery of the tamper-evident cap, is disposed on the outer periphery of the packaging sleeve.

Likewise, in another embodiment, it is possible that radially inward directed knobs which engage in a respective associated latching groove on the outer periphery of the packaging sleeve are formed, for example on the inner periphery of the annular collar of the sleeve part.

Instead of radially projecting knobs, it is also possible to dispose axially projecting knobs, which respectively cooperate with associated latching grooves on the opposite part, either on the sleeve part of the tamper-evident cap or on the annular collar of the packaging sleeve.

This is therefore a key rotational connection that ensures that the tamper-evident cap can be pushed onto and engaged with the packaging sleeve only in a specific rotational position, wherein, according to a preferred feature, the rotational position of the tamper-evident cap is transmitted to the packaging sleeve, so that the tamper-evident cap can also be pushed onto the packaging sleeve only when the sealing stopper is connected to the packaging sleeve in its checked sealing position.

It has been mentioned previously that this is a multiple seal between the sealing stopper and the packaging sleeve. More specifically, there is a first front-side sealing surface between the upper end face of the packaging sleeve in connection with the sealing stopper, wherein, in a preferred further development, it is provided that the sealing surface is additionally configured as a soft sealing ring which is integrally connected with the remaining plastic material of the sealing stopper in a 2K process.

As a result of the sealing insert, there is thus a flexible, elastomeric front-side sealing surface which provides a first sterile barrier.

In axial direction, there are two other adjoining sterile barriers which are configured to act radially. They are respectively formed by sealing lips that are spaced apart, rest outwardly against the inside of the sealing collar of the packaging sleeve in radial direction and form two sealing surfaces, which lie one behind the other, are separated in axial direction and constitute two additional sterile barriers.

The mentioned medical sleeve packaging is thus provided for a reliable securing of sterility with long-term preservation of the sterile conditions.

Because the tamper-evident cap according to the invention can only be pushed onto the packaging sleeve in a specific rotational position and this rotational position is also mechanically locked and controllable, a push-type assembly is preferred. It is therefore provided that the sleeve-like tamper-evident cap can be pushed onto and engaged with the packaging sleeve in the sense of a push-type assembly only in a specific rotational position.

The specific sealed rotational position is checked by means of the aforementioned mechanical position control of the centering lug which preferably projects from the lower annular periphery of the sleeve part of the tamper-evident cap and can be brought into engagement in an associated, upwardly open groove on the outer periphery of the packaging sleeve.

Alternative designs of this positionally secured key connection have already been described above.

According to a preferred feature of the invention, a total of two designs of a tamper-evident cap are proposed. However, the invention is not limited to this.

In a first embodiment, it is provided that the sealing stopper is connected to a toggle which projects axially from the upper cover surface of the sealing stopper, wherein it is preferred for the toggle and the material of the sealing stopper to consist of a one-piece part. The toggle is thus integrally and non-rotatably connected to the sealing stopper.

In other embodiments, however, it can be provided that the toggle is separate from the cover surface of the sealing stopper and is connected to said cover surface by means of an adhesive connection or a plug or latching connection.

The following is based upon a non-rotatable, integral connection of the toggle with the sealing stopper and, according to a further feature, it is provided that the toggle constitutes the positional securing on the tamper-evident cap. Therefore, in a first embodiment, a tamper-evident cap is provided, which comprises a slot opening in its upper cover surface through which the toggle engages, so that a non-rotatable positional securing between the sealing stopper and the tamper-evident cap is achieved.

The arrangement of a toggle which projects from the tamper-evident cap provides the advantage that, if the toggle has intentionally been turned, it can be seen that the packed and sterilized packaging has been tampered with, which is an indication that the packaging is unusable.

According to a feature of the invention, it is provided that the respective tamper-evident cap consists of two sleeve parts which are separated from one another by separation seams, and the two sleeve parts are integrally connected to one another via an annular groove with a reduced cross section and can be pulled apart with a pull tab, so that the upper sleeve part can be separated from the lower part when the pull tab is pulled apart.

On the other hand, if the toggle projects from the upper sleeve part and the toggle is turned unintentionally, the separation seams tear open and tampering with the packaging sleeve can be detected.

According to another design example of the invention, it is provided that the tamper-evident cap and its upper sleeve parts form a self-contained sleeve that covers the toggle of the sealing stopper, wherein in this case the toggle of the sealing stopper is held non-rotatably and in a positionally secured manner in an associated receiving opening separated by two ribs, but is not visible from outside.

In both cases, therefore, tamper-evident caps are proposed, which transmit the rotational position of the sealing stopper and thus its sealing position to the tamper-evident cap and the tamper-evident cap itself can only be snapped onto the packaging sleeve in a specific rotational position.

As a result, on the one hand, the packaging sleeve can also be used without the tamper-evident cap and the triple sterile sealing surfaces are preserved, and, on the other hand, the tamper-evident cap in its various designs can be used as an additional part with the packaging sleeve according to the invention, thus providing an additional control function with respect to the preservation of the preferable three separately configured sealing surfaces.

In particular when the packaging sleeve is made of a transparent plastic, seal checks in the vacuum chamber can check whether the three mentioned sealing surfaces are functioning properly or whether leaks are present.

The tamper-evident cap is preferably made of a polyethylene or polypropylene material, which ensures that a pull tab can be disposed with interjacent cross section-reduced separation seams.

The subject matter of the present invention emerges not only from the subject matter of the individual claims, but also from the combination of individual claims amongst one another.

All information and features disclosed in the documents, including the abstract, in particular the spatial configuration shown in the drawings, could be claimed as essential to the invention, insofar as they are individually or in combination novel with respect to the state of the art. The use of the terms "essential" or "according to the invention" or "essential to the invention" is subjective and does not imply that the thusly labeled features must necessarily be a component of one or more claims.

BRIEF DESCRIPTION OF THE DRAWINGS

The invention is explained in more detail in the following on the basis of drawings showing only one possible design. Further essential features and advantages of the invention will emerge from the drawings and their description.

The Figures show.

DETAILED DESCRIPTION OF THE INVENTION

Figure 1:
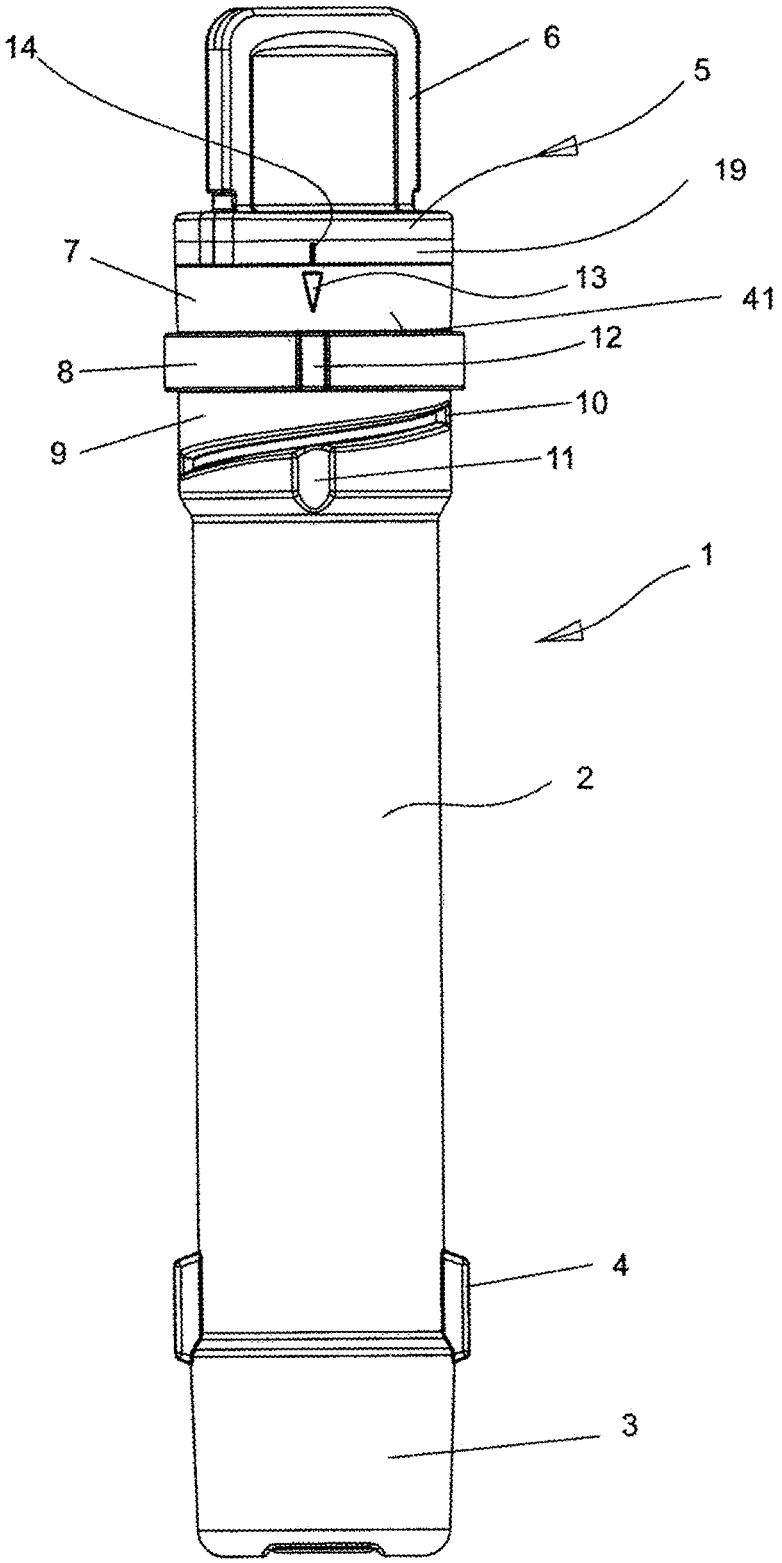
FIG. 1 show a perspective view of a packaging sleeve without the tamper-evident cap in the sealing position of the sealing stopper.

The packaging sleeve 1 of FIG. 1 consists essentially of a hollow cylindrical sleeve body 2, preferably of a transparent plastic. The type of packaging sleeve and its function is the subject matter of the older patent application DE 10 2015 012 898 A1, for example.

Reference to the description found there is made in relation to the following description.

The sleeve body 2 is usually cylindrical. It can, however, also be configured as an oval body, wherein it is required that the upper and lower end faces of the sleeve body with the collars placed thereupon are cylindrical.

The bottom of the sleeve body 2 is formed by the base of a cone 3, which is closed at the bottom.

In the area of the base of the cone 3 or above it, lobe-shaped lugs 4 are provided, which project radially beyond the outer periphery of the sleeve body 2 and provide a means to prevent the sleeve body 2 from rolling. The sleeve body 2 should therefore not roll off a storage surface. This is prevented by the lugs 4.

Figure 2:
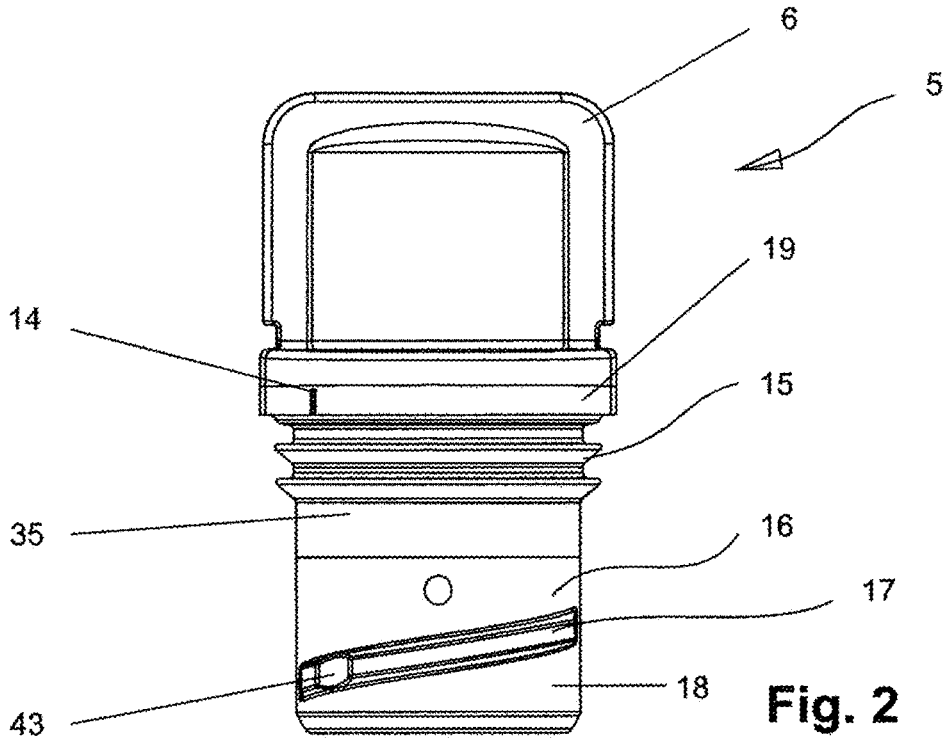
FIG. 2 shows a sealing stopper of FIG. 1 in a side view.

In FIG. 2, the packaging sleeve 1 is shown without a sealing stopper 5. It consists essentially of an upper sealing collar 7, at the upper annular edge 38 of which a first sealing surface 39 is configured in relation to the sealing stopper 5 to be discussed later.

A visually discernible marking symbol 13 is also disposed in the area of the sealing collar 7.

The sealing collar 7 is adjoined by an annular collar 8 with an enlarged diameter, on the outer periphery of which at least one, but preferably two, separate latching grooves 12 are incorporated.

The annular collar 8 is adjoined in axial direction by a threaded region 9 with a reduced diameter, in which a thread 10 with associated thread helices is formed.

An upwardly open latching groove 11, which is formed as a recessed region on the periphery of the threaded region 9, is also disposed in the threaded region 9.

Figure 3:
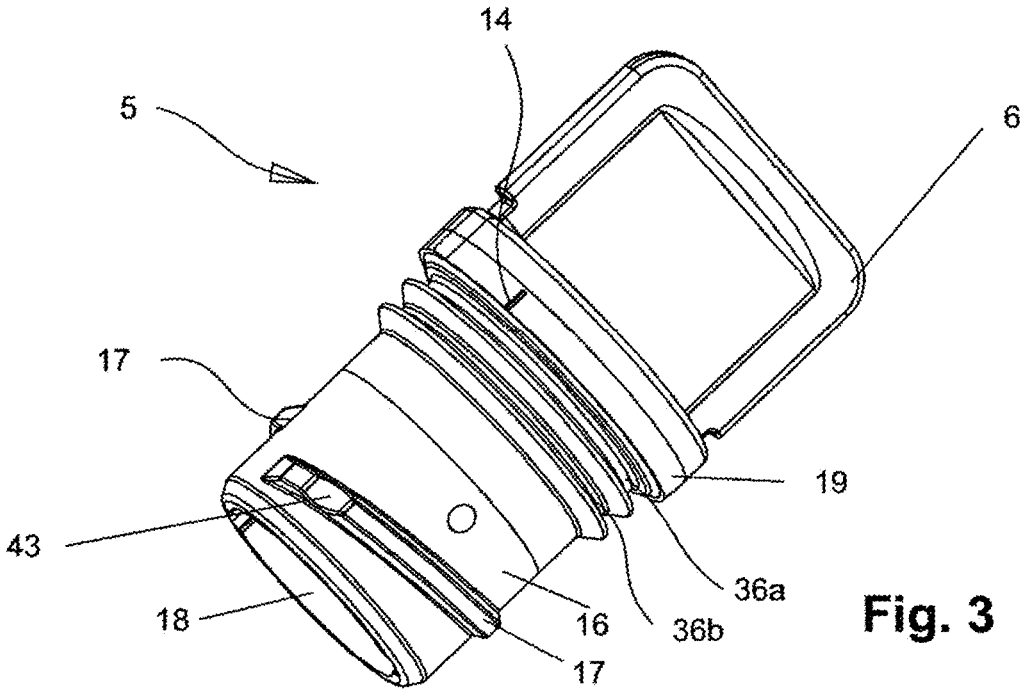
FIG. 3 shows a perspective view of the sealing stopper of FIG. 2.
Figure 4:
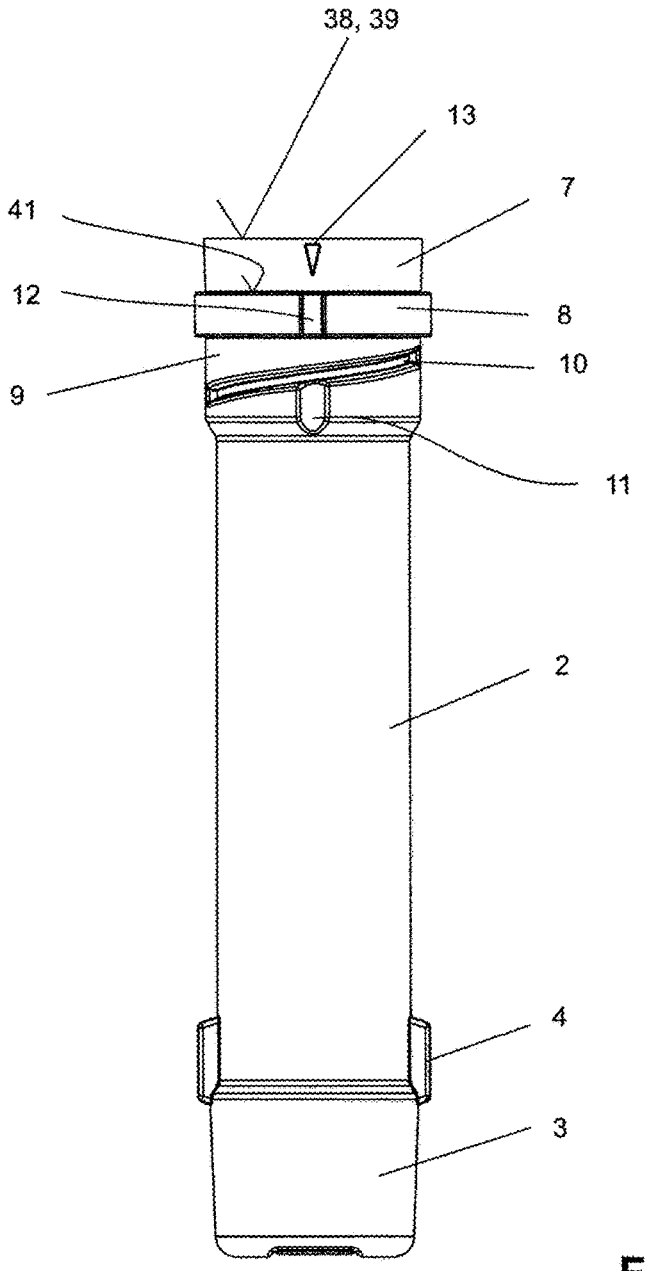
FIG. 4 shows the depiction of the packaging sleeve of FIG. 1 without the sealing stopper.

The sealing stopper 5, which is to be sealingly inserted into the sleeve body 2, is shown in more detail in FIGS. 2 and 3. It consists of an upper toggle 6, which is integrally connected to the plastic material as a handle for the rotation of the sealing stopper 5 and is connected to said stopper in the region of an annular extension 19.

A visually discernible marking symbol 14, which must be brought into alignment with the sleeve body-side marking symbol 13, is disposed in the region of the annular extension 19.

The annular extension 19 is adjoined by a region which is reduced in diameter and is formed by spaced apart, parallel sealing lips 15 which, in conjunction with the associated inner surfaces of the sleeve body 2, form the sealing surfaces 36*a*, 36*b* to be described later.

This two-fold sealing region with respect to the sealing surfaces 36*a*, 36*b*, is adjoined by a reduced-diameter sealing ring 35, which transitions into a threaded extension 16 in which a thread is formed of which a thread helix 17 is visible.

A latching recess 43, which cooperates in the threaded region 9 with an associated latching groove 11 on the outer periphery of the sleeve body 2, is formed in the area of the thread helix 17.

The latching recess 43 engages in the latching groove 11 only when the thread 17 of the sealing stopper 5 is inserted into the associated thread 10 of the sleeve body 2 in the proper position. The operator is thus haptically informed that the end stop for the engaged threads 10, 17 is reached during a rotational movement.

Thus, during assembly, the rotational position of the sealing stopper 5 in the sleeve body 2 of the packaging sleeve 1 is haptically controlled.

However, such a haptic control that is provided only as an additional measure to the visual inspection shown in FIG. 1 can be omitted.

If, once the correct rotational position between the sealing stopper 5 and the sleeve body 2 is reached, according to FIG. 1 the marking symbol 14 disposed on the sleeve body 2 is opposite to the marking symbol 13 disposed on the sleeve body.

This positionally secured rotational position between the sealing stopper 5 and the sleeve body 2 simultaneously ensures that the sealing surfaces 36*a*, 36*b* (see FIG. 3) at the inner periphery of the sealing collar 7 are functioning.

The thusly set rotational position, which can on the one hand be achieved by the alignment of the marking symbols 14, 15, and (additionally optionally) on the other hand by the haptic engagement of the latching recess 43 into the latching groove 11, makes it possible to check and secure the securing position of both embodiments of the tamper-evident caps 20, 30.

It should also be noted that the sealing stopper 5 is hollow and the stopper end 18 does not constitute a closure. The closure of the sealing stopper 5 takes place in the area of the annular extension 19.

Figure 5:
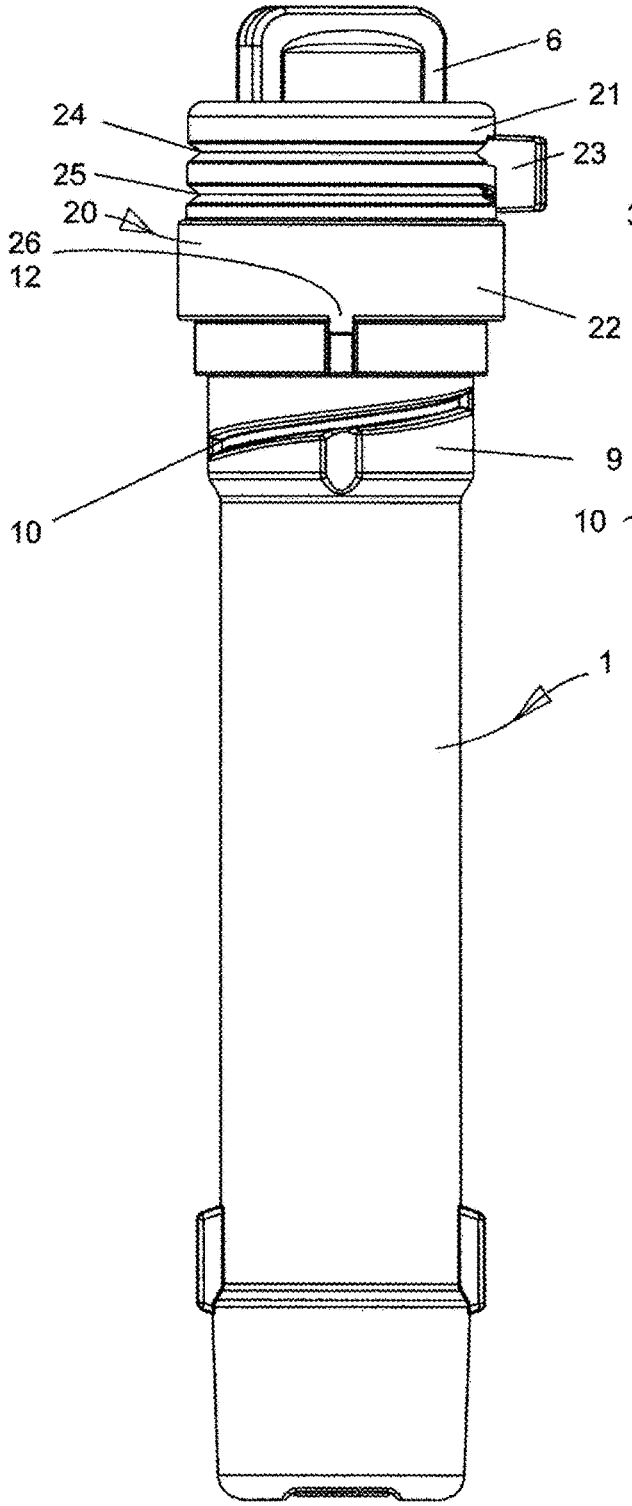
FIG. 5 shows the depiction of the packaging sleeve with the sealing stopper and a tamper-evident cap in a first design.
Figure 6:
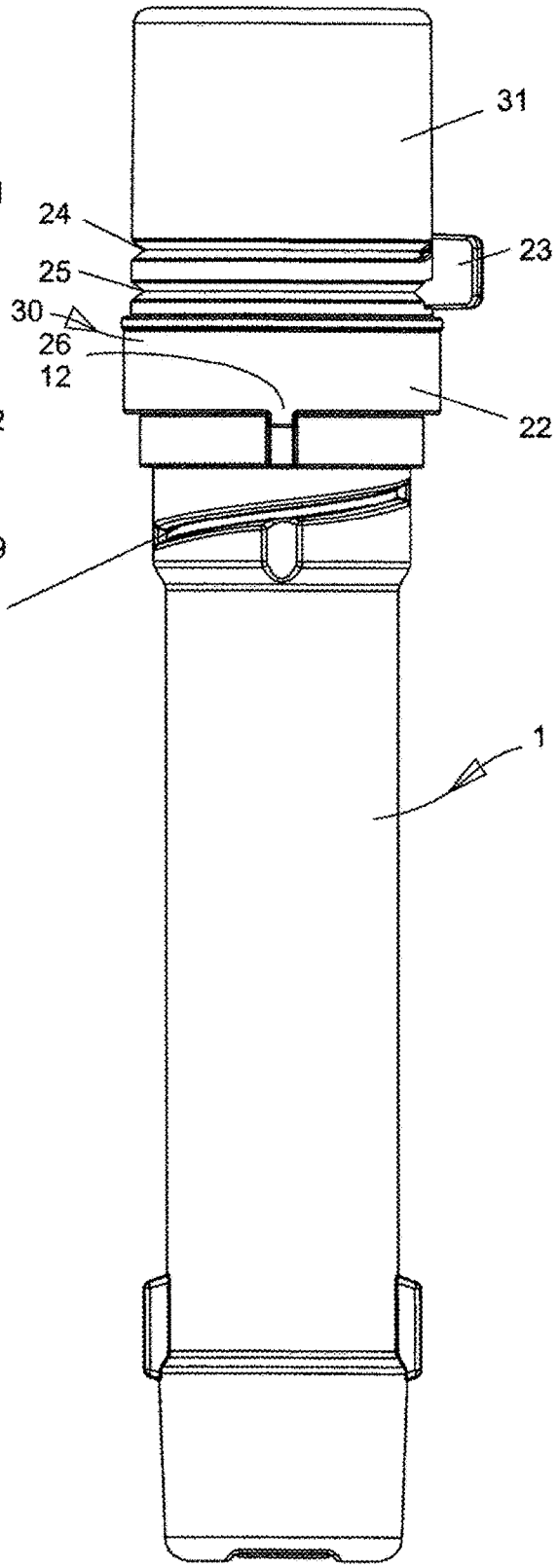
FIG. 6 shows the same depiction as FIG. 5 with a tamper-evident cap in a second design.

Coming back to FIGS. 5 and 6, it is stated that the first embodiment of the tamper-evident cap 20 consists of two separable sleeve parts 21, 22 which can integrally be separated in the plastic material by two cross section-reduced separation seams 24, 25, wherein the two separation seams 24, 25 are connected to one another by a tear-off pull tab 23, if the pull tab 23 has not yet been actuated.

Figure 8:
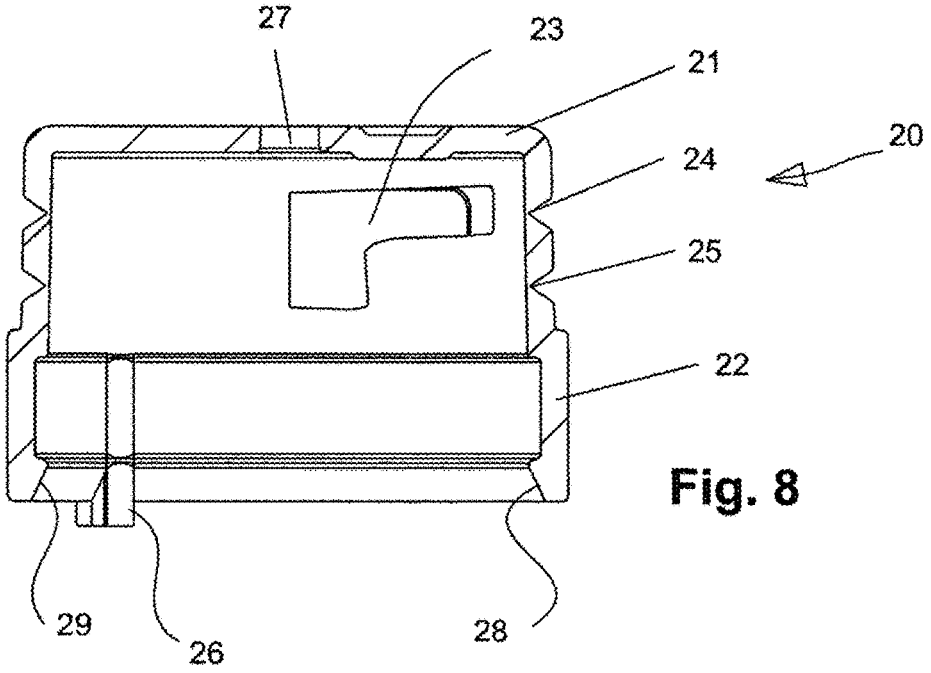
FIG. 8 shows a section through the tamper-evident cap of FIG. 5.
Figure 12:
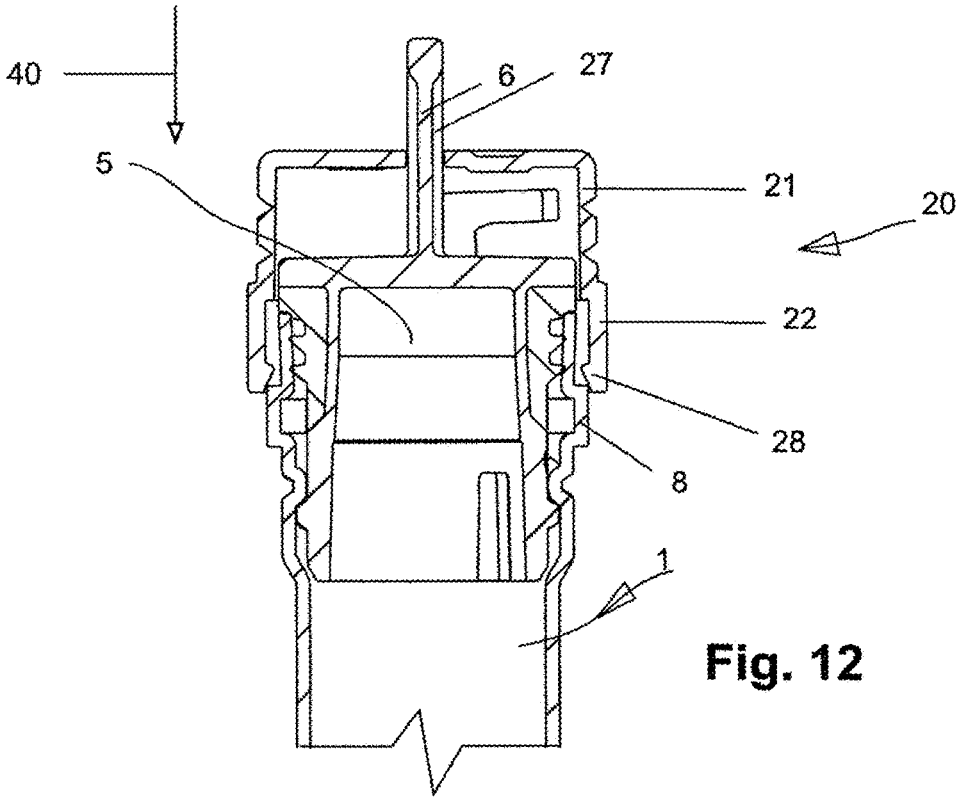
FIG. 12 shows the same depiction as FIG. 11 with the other embodiment of the tamper-evident cap in the unsecured position.

The difference between the tamper-evident cap 20 of FIG. 5 and the tamper-evident cap 30 of FIG. 6 is that, according to FIG. 8, a slot opening 27 is provided in the upper cap area of the tamper-evident cap 20 of FIG. 5, by means of which the toggle 6 engages through the sealing stopper 5 in a rotationally secured manner, as shown in cross section in FIG. 12 for example.

Figure 7:
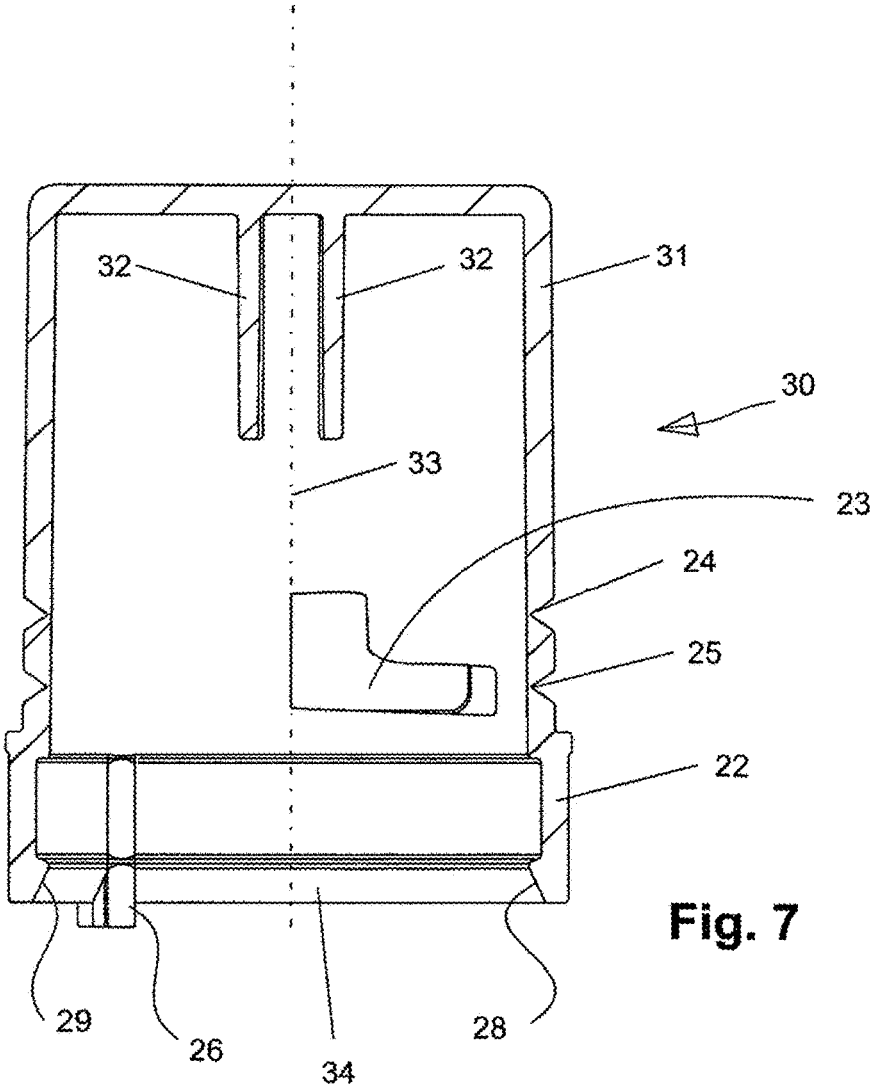
FIG. 7 shows a section through the tamper-evident cap of FIG. 6.

However, in the tamper-evident cap 30 of FIG. 6, the upper sleeve part 31 is formed by a self-contained cap, which accommodates the toggle 6 of the sealing stopper 5 in its interior in a rotationally secured manner, as shown in FIG. 7.

FIG. 7 shows that the toggle is accommodated in a receiving opening 33 on the inside of the upper sleeve part 31, wherein the receiving opening is formed by two ribs 32 which are spaced apart and axially directed inward.

It can also be seen that both tamper-evident caps 20, 30 are provided on the lower sleeve part 22 with at least one axially projecting centering lug 26, which cooperates with the previously described latching groove 12 on the outer periphery of the sleeve body 2.

Figure 14:
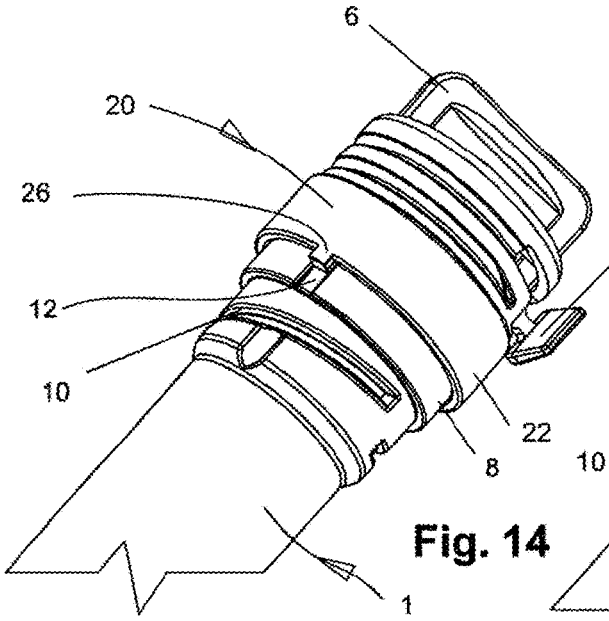
FIG. 14 shows the partial securing position of the mechanical securing of a first embodiment of the tamper-evident cap, wherein the non-rotatable connection has not yet been established.
Figure 15:
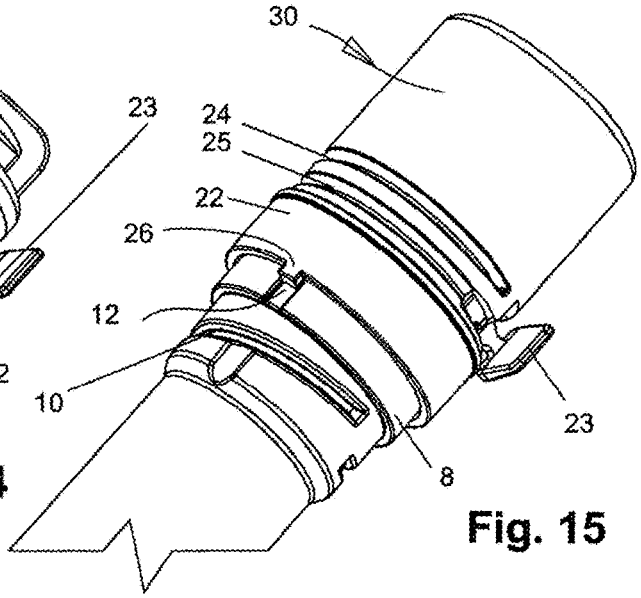
FIG. 15 shows the same depiction as FIG. 14 with the tamper-evident cap in the second design.

From the sectional views of FIGS. 7 and 8, it can further be seen that the lower sleeve part 22 of the tamper-evident cap 20, 30 is configured as a latching collar 28 comprising inclined inlet bevels 29, so that both tamper-evident caps 20, 30 are pushed onto the sleeve body in the sense of a push-type assembly (see FIGS. 11 and 12) and connected to one another in the proper position, as shown in FIGS. 14 and 15.

In the securing position (final position), the respective at least one centering lug 26 of the lower sleeve part 22 of the tamper-evident cap 20, 30 engages in the associated upwardly open latching groove 12 of the sleeve body 2.

Figure 9:
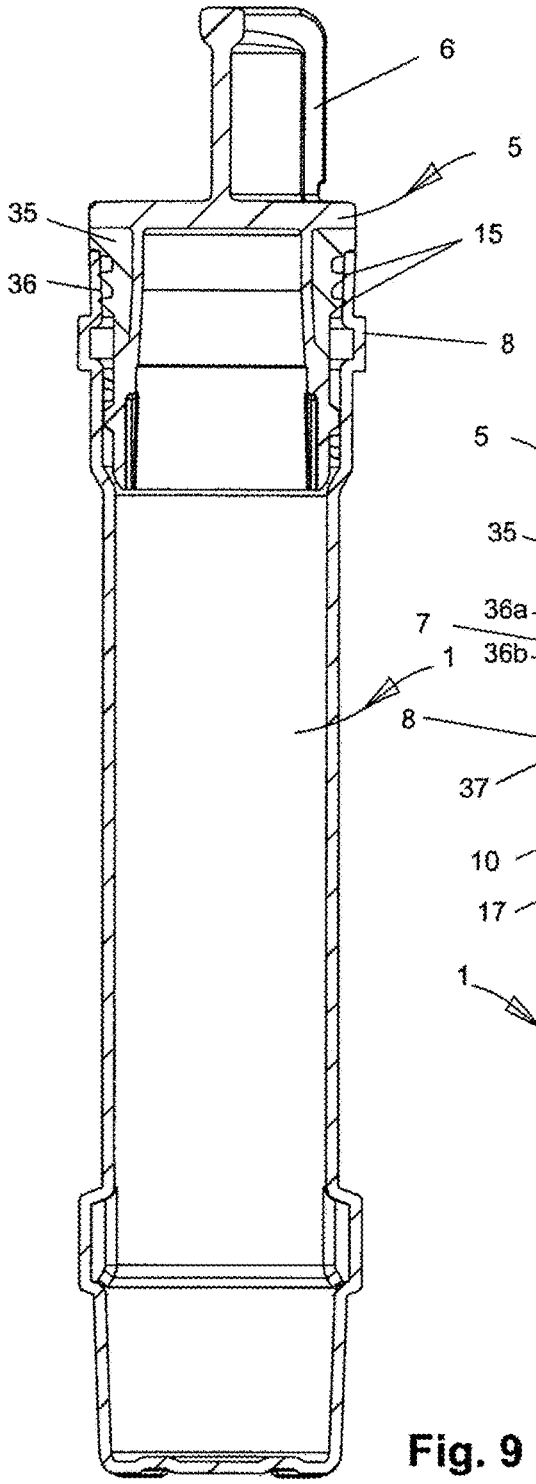
FIG. 9 shows a section through the packaging sleeve without a tamper-evident cap according to FIG. 1.
Figure 10:
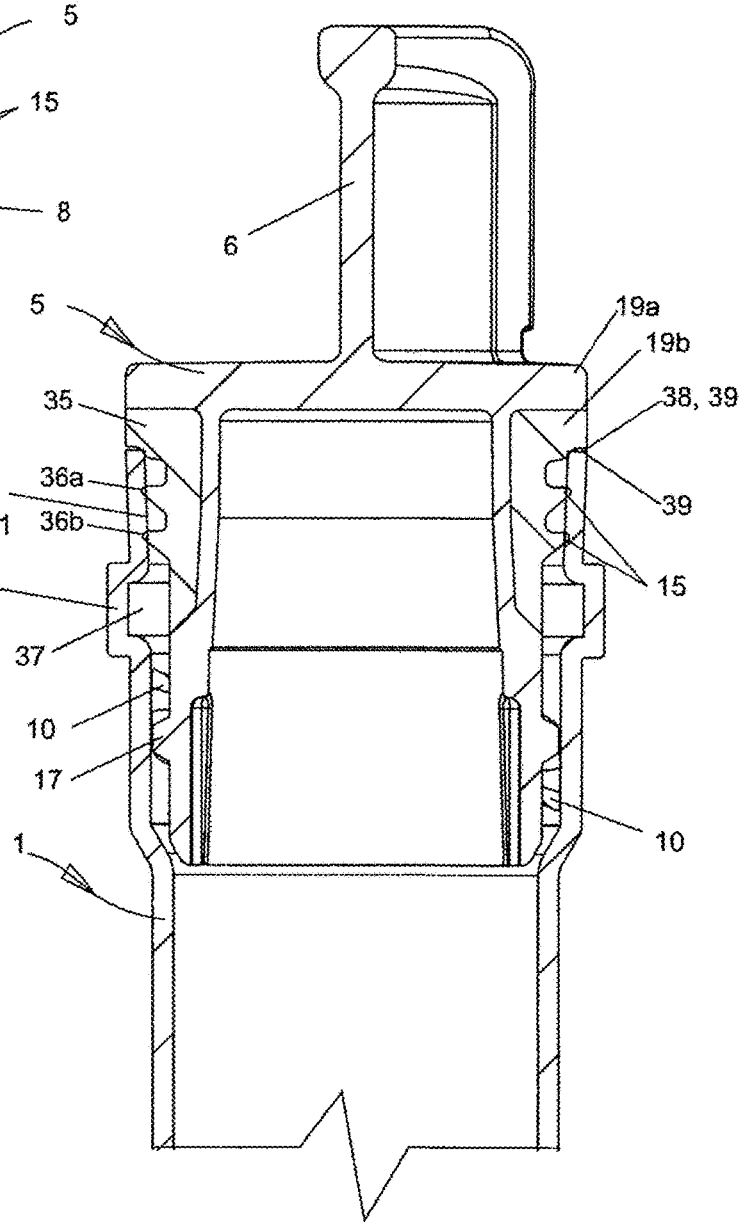
FIG. 10 shows an enlarged section of FIG. 9.

FIGS. 9 and 10 show the finished sealing position of the sealing stopper 5 with a control of the rotational position, in which it can be seen that the sealing stopper 5 is configured as a two-part piece that was, however, produced in a single plastic injection molding process. According to FIGS. 9 and 10, an annular extension 19*b* made of a different material is formed on the outer periphery of the sealing stopper 5 and forms a one-piece part with the upper annular extension 19*a*, which is, however, made of a different material.

Thus, according to FIG. 10, a first sealing surface 39 is formed between the annular edge 38 of the sleeve body 2 and the associated edge of the softer material annular extension 19*b*.

Adjoining this in axial direction are two separate, further sealing surfaces 36*a*, 36*b*.

Each of the sealing surfaces is formed by a peripheral sealing lip 15, wherein the sealing lips are formed parallel, spaced apart and peripherally in the softer material annular extension 19*b*. They thus form the aforementioned axially separated sealing surfaces 36*a*, 36*b* on the inner periphery of the sleeve body 2.

A circumferentially enlarged annular collar 8 forms an annular groove 37, which is, however, present only for manufacturing reasons.

The threaded screw region of the engaged threads between the thread 10 of the sleeve body 2 and the thread helices 17 of the sealing stopper 5 is disposed below the annular groove 37.

Figure 11:
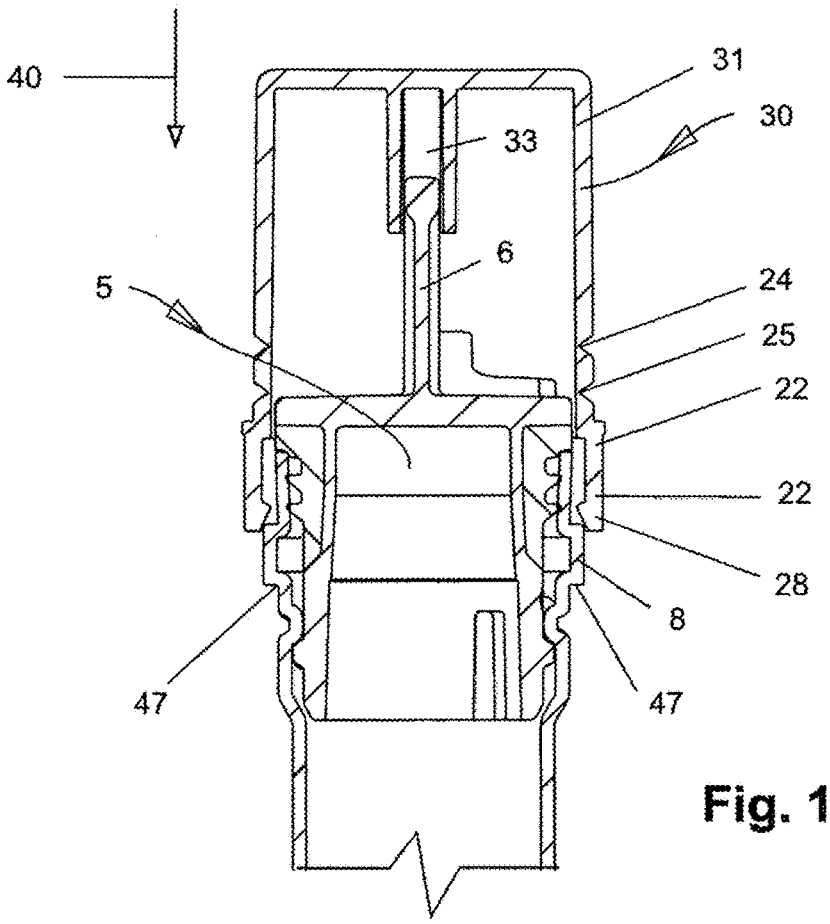
FIG. 11 shows a section of FIG. 10 with a partially placed tamper-evident cap in the unsecured position.

FIGS. 11 and 12 show a working position of the two tamper-evident caps 20, 30, wherein the securing connection with the sleeve body 2 of the packaging sleeve 1 has not yet been established. It can thus be seen that the latching collar 28 is still resting on the upper side of the annular collar 8, and has not yet been brought into engagement with the latching edge 47 on the lower side of the annular collar 8.

FIGS. 11 and 12 thus show both tamper-evident caps 20, 30 in an intermediate position prior to reaching their positionally secured latching position.

As the assembly progresses further, the respective tamper-evident cap 20, 30 is thus pressed downward in the direction of the arrow 40, and the latching collar 28 consequently expands radially and arrives at a position over the annular collar 8. The inlet bevel 29 slides over the upper surfaces of the annular collar 8 and then brings the lower latching collar 28 into a positionally secured engagement of the latching edge 47 of the annular collar 8.

Figure 13:
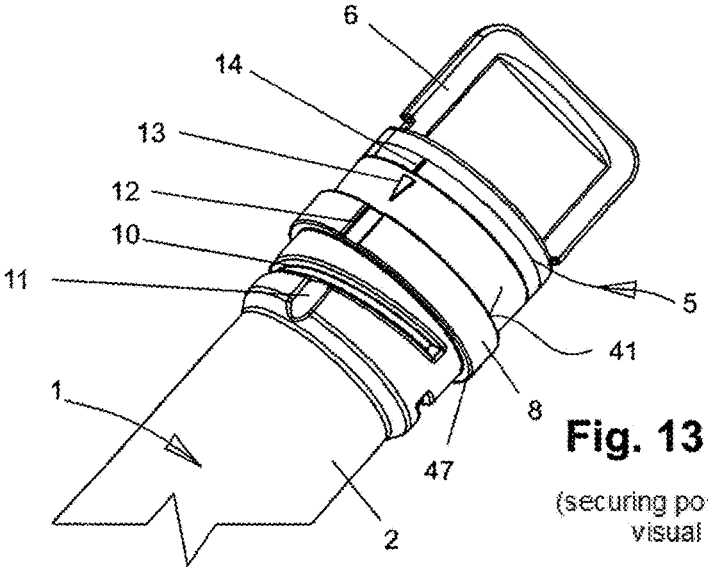
FIG. 13 shows the perspective side view of the packaging sleeve of FIG. 1 without the tamper-evident cap with the depiction of the securing position between the sealing stopper and the packaging sleeve.

FIG. 13 shows the visually controllable securing of the rotational position between the sealing stopper 5 and the sleeve body 2 of the packaging sleeve 1, because it can be seen that the sealing stopper 5 with its marking symbol 14 must be brought into alignment with the marking symbol 13 of the sleeve body 2.

Figure 16:
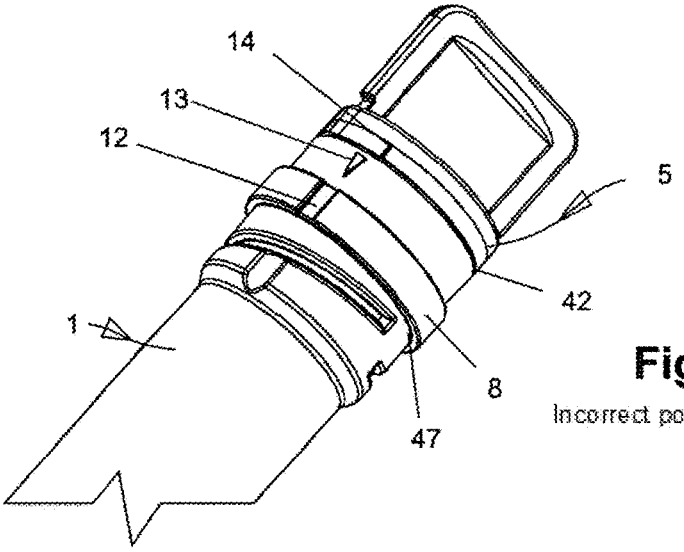
FIG. 16 shows the depiction of the incorrect rotational position between the sealing stopper and the packaging sleeve.

If this rotational position is not reached, the two marking symbols 13, 14 deviate from one another, which then results in a visually controllable incorrect position as shown in FIG. 16.

Figure 17:
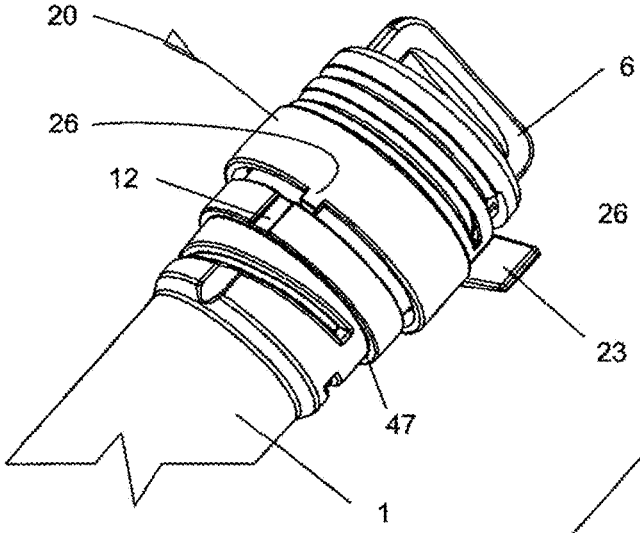
FIG. 17 shows the depiction of an incorrect rotational position between the first embodiment of the tamper-evident cap and the packaging sleeve.
Figure 18:
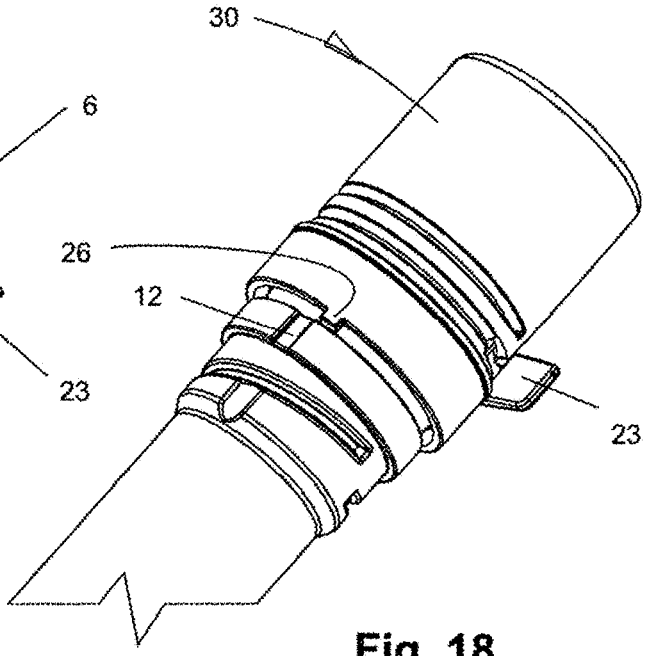
FIG. 18 shows the depiction of the incorrect rotational position between the second embodiment of the tamper-evident cap and the packaging sleeve.

The visually identifiable incorrect position of FIG. 16 is continued in the depiction of FIGS. 17 and 18, because it can be seen that, when the respective tamper-evident cap 20, 30 is placed onto the sealing stopper 5 in the incorrect position of FIG. 16, the axially projecting centering lug 26 is not in engagement with the sleeve body-side latching groove 12 as shown in FIGS. 17 and 18.

Incorrect assembly is thus impossible.

The reason for this safety measure is that the toggle 6 of the sealing stopper 5 is non-rotatably connected to the respective tamper-evident cap 20, 30 and, in this "incorrect" rotational position according to FIG. 16, cannot be brought into engagement in the sleeve body-side latching groove 12 with its centering lug 26.

Figure 19:
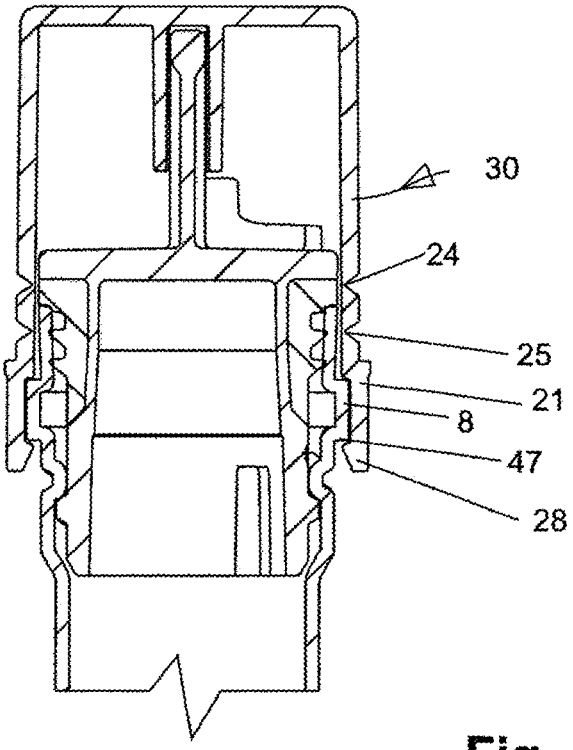
FIG. 19 shows the securing position of the packaging sleeve with a completely snapped-on tamper-evident cap in the second design.
Figure 20:
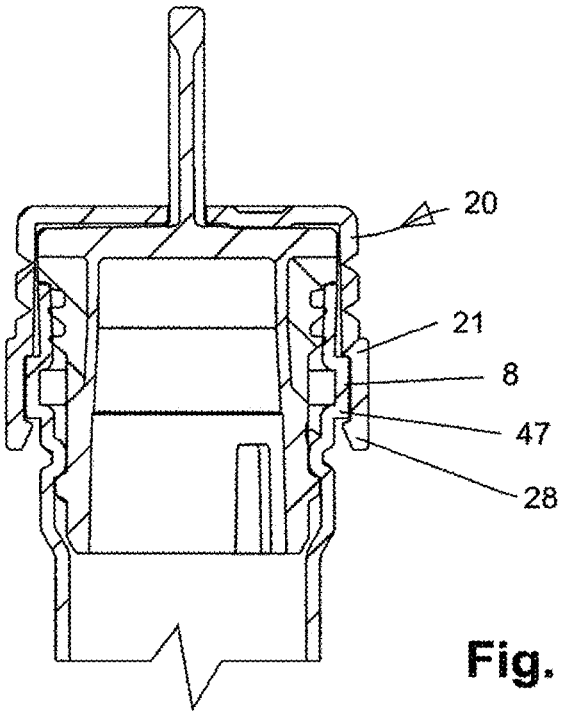
FIG. 20 shows the finished securing position of the packaging sleeve with the tamper-evident cap in the first design.

The two completely established securing positions are shown in cross section in FIGS. 19 and 20. FIG. 19 shows the tamper-evident cap 30 in its completed securing position, wherein it is now ensured that the securing position can be established only when the sealing stopper 5 is completely screwed into the sleeve body 2 and sealed, and also only then can the lower latching collar 28 of the tamper-evident cap 30 be brought into engagement with the associated latching edge 47 of the annular collar 8 of the sleeve body 2.

FIG. 20 also shows the positionally secured latching position of the tamper-evident cap 20.

If the sealing stopper 5 is not completely screwed onto the sleeve body 2, this is indicated by the lack of alignment of the two markers 13 and 14 on the one hand, and, on the other hand, a gap 42 forms between the sleeve body 2 and the sealing stopper 5 as in FIG. 16.

Figures 21, 22:
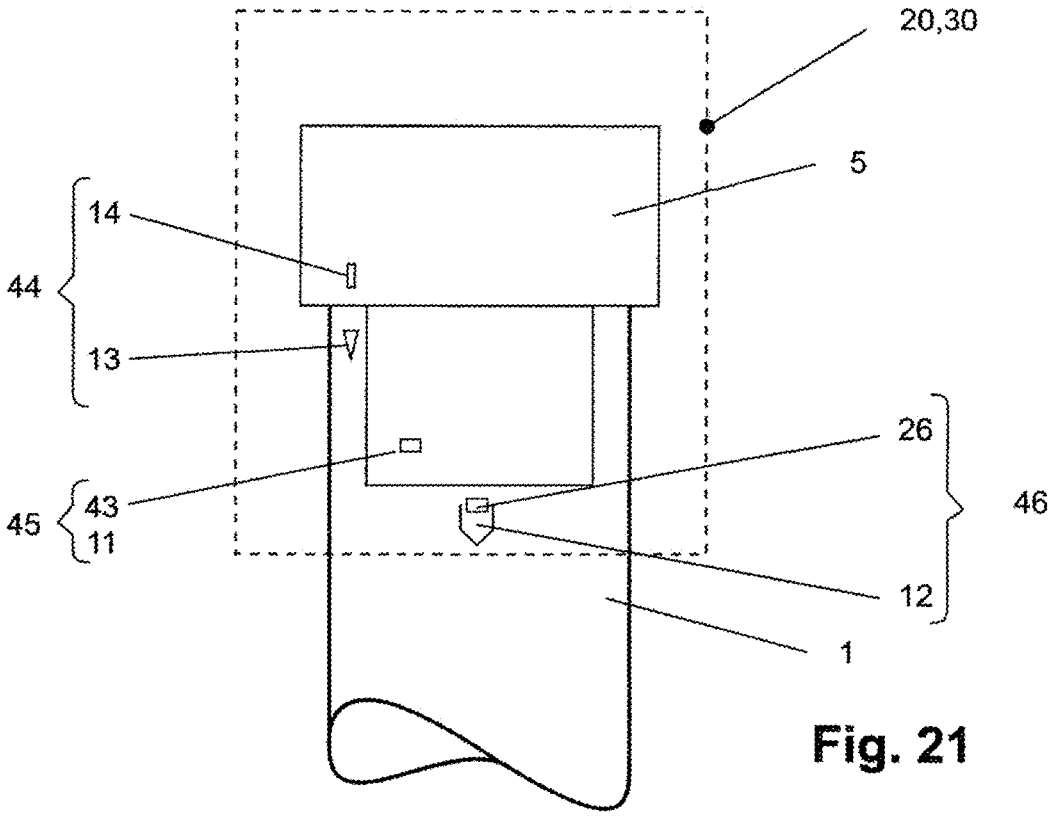
FIG. 21 schematizes the serial arrangement of a control chain having different control measures.
FIG. 22 shows the depiction of FIG. 21 with a depiction of the sequence of the different control chains associated with one another when connecting the mentioned parts.

FIG. 21 schematically shows the succession of the various control mechanisms of the invention.

In the first control stage, the alignment of the marking symbols 13, 14 between the sealing stopper 5 and the sleeve body 2 is checked with the visual inspection 44.

In the second control stage, the mechanical position control 45, the positional association between the sealing stopper 5 and the sleeve body 2 is additionally checked by means of haptic feedback, in that the latching recess 43 disposed on the sealing stopper 5 engages in the associated latching groove 11 on the outer periphery of the sleeve body 2 in a haptically perceptible manner.

In the third control stage, a further position control 46 is created, which ensures a secure rotational position and closing position between the tamper-evident cap 20, 30 and the sleeve body 2, in that the one or more centering lugs 26 disposed on the tamper-evident cap 20, 30 can be brought into engagement with the sleeve body-side latching grooves 12 only when the correct rotational position between the sealing stopper 5 and the sleeve body 2 has been established.

According to FIG. 22, this is a chain of control steps, wherein a haptically perceptible position control between the sealing stopper and the sleeve body 2 can additionally be provided after the first visual inspection 44, but can also be omitted.

The decisive factor here is the mechanical position control 46 between the tamper-evident cap and the sleeve body 2, wherein this position control only works if the sealing stopper 5 is covered by the tamper-evident cap 20, 30 in the correct position.

| Drawing legend | |
|---|---|
| 1 | Packaging sleeve |
| 2 | Sleeve body |
| 3 | Base of the cone |
| 4 | Base |
| 5 | Sealing stopper |
| 6 | Toggle |
| 7 | Sealing collar (of 1) |
| 8 | Annular collar (of 1) |
| 9 | Threaded region |
| 10 | Thread |
| 11 | Latching groove (for 5) |
| 12 | Latching groove (for 20) |
| 13 | Marking symbol (of 1) |
| 14 | Marking symbol (of 5) |
| 15 | Sealing lips (of 5) |
| 16 | Threaded extension |
| 17 | Thread helix (of 5) |
| 18 | Stopper end |
| 19 | Annular extension a, b |
| 20 | Tamper-evident cap |
| 21 | Sleeve part (top) |
| 22 | Sleeve part (bottom) |
| 23 | Pull tab |
| 24 | Separation seam top |
| 25 | Separation seam bottom |
| 26 | Centering lug |
| 27 | Slot opening (for 6) |
| 28 | Latching collar |
| 29 | Inlet bevel |
| 30 | Tamper-evident cap |
| 31 | Sleeve part (top) |
| 32 | Rib |
| 33 | Receiving opening (for 6) |
| 34 | Opening |
| 35 | Sealing ring (of 5) |
| 36 | Sealing surface a, b |
| 37 | Annular groove |
| 38 | Annular edge (of 1) |
| 39 | Sealing surface (of 38) |
| 40 | Direction of the arrow |
| 41 | Stop surface (of 1) |
| 42 | Gap |
| 43 | Latching recess (of 5 in 11) |
| 44 | Visual inspection (between 1 & 5) |
| 45 | Position control (between 1 & 5) |
| 46 | Position control (between 20, 30 & 1 |
| 47 | Latching edge (of 8) |

What is claimed is:

1. A medical packaging sleeve comprising:

an approximately cylindrical sleeve body having an open end;

a sealing stopper attachable to the open end of the sleeve body via a threaded screw connection to provide a tight seal therebetween;

a sleeve-shaped tamper-evident cap that extends over the sealing stopper for sterile use, wherein a position of the sealing stopper is fixable by the tamper-evident cap when the tamper evident cap is engaged with the sleeve body; and a marking symbol on an outer circumference of each of the sealing stopper and the sleeve body that provide a visual indication of a sealed rotational position between the sealing stopper and the sleeve body;

wherein the tamper-evident cap is non-rotatably connected to the sealing stopper and engageable with the sleeve body only in the sealed rotational position of the sealing stopper.

2. The packaging sleeve of claim 1, wherein the sealed rotational position between the sealing stopper and the sleeve body further comprises a haptically perceptible latching position.

3. The packaging sleeve of claim 2, wherein the haptically perceptible latching position comprises a latching recess on the sealing stopper and a latching groove on the sleeve body.

4. The packaging sleeve of claim 1, wherein at least one axially projecting centering lug is disposed on a lower sleeve part of the tamper-evident cap and alignable with an upwardly open latching groove disposed on a periphery of the packaging sleeve.

5. The packaging sleeve of claim 4, wherein the lower sleeve part of the tamper-evident cap is configured as a radially elastically expandable latching collar comprising inclined inlet bevels.

6. The packaging sleeve of claim 5, wherein the latching collar can be snapped on over an annular collar of the sleeve body in a radially expandable manner.

7. The packaging sleeve of claim 1, wherein the tamper-evident cap can be pushed onto the sleeve body only when the sealing stopper is in the sealed rotational position on the sleeve body.

8. The packaging sleeve of claim 1, wherein a multiple seal is present between the sealing stopper and the sleeve body of the packaging sleeve.

9. The packaging sleeve of claim 8, wherein the multiple seal comprises elastomeric sealing lips on the sealing stopper that engage an inner annular surface adjacent the open end of the sleeve body.

10. The packaging sleeve of claim 1, wherein the tamper-evident cap consists of two sleeve parts, wherein the sleeve parts are separable from one other by separation seams and are integrally connected to one another via an annular groove with a reduced cross section, and wherein the sleeve parts can be pulled apart with a pull tab.

11. The packaging sleeve of claim 1, wherein the threaded screw connection comprises a threaded region on each of the sleeve body and the sealing stopper, wherein the sealed rotational position therebetween comprises a haptically perceptible latching position.

12. The packaging sleeve of claim 11, wherein the haptically perceptible latching position comprises a latching recess on a periphery of the threaded region on the sleeve body and a latching groove within the threaded region of the sleeve body.

13. A medical packaging sleeve comprising:

an approximately cylindrical sleeve body having an open end;

a sealing stopper attachable to the open end of the sleeve body via a threaded screw connection to provide a tight seal therebetween;

a sleeve-shaped tamper-evident cap that extends over the sealing stopper for sterile use, wherein a position of the sealing stopper is fixable by the tamper-evident cap when the tamper evident cap is engaged with the sleeve body; and a marking symbol on each of the sealing stopper and the sleeve body that provide a visual indication of a sealed rotational position between the sealing stopper and the sleeve body;

wherein the tamper-evident cap is non-rotatably connected to the sealing stopper and engageable with the sleeve body only in the sealed rotational position of the sealing stopper, wherein the non-rotatable connection between the sealing stopper and the tamper-evident cap consists of a manually actuatable toggle connected to the sealing stopper and engageable in a shape-adapted opening on an end of the tamper-evident cap.

14. The packaging sleeve of claim 13, wherein the shape adapted opening comprises two ribs formed on an inner surface of the end of the tamper-evident cap and configured to accept the toggle of the sealing stopper.

15. The packaging sleeve of claim 13, wherein the shape adapted opening comprises a slot in the end of the tamper-evident cap through which the toggle of the sealing stopper protrudes.

16. A medical packaging sleeve comprising:

an approximately cylindrical sleeve body having an open end;

a sealing stopper comprising a manually actuatable toggle on a top end, at least one elastomeric sealing lip on an outer periphery configured to engage an inner annular surface of the sleeve body, and a threaded region on the outer periphery configured to engage a corresponding threaded region on the inner annual surface of the sleeve body to provide a tight seal therebetween;

a sleeve-shaped tamper-evident cap that extends over the sealing stopper for sterile use, wherein a position of the sealing stopper is fixable by the tamper-evident cap when the tamper evident cap is engaged with the sleeve body; and a marking symbol on each of the sealing stopper and the sleeve body that provide a visual indication of a sealed rotational position between the sealing stopper and the sleeve body;

wherein the tamper-evident cap is non-rotatably connected to the sealing stopper and engageable with the sleeve body only in the sealed rotational position of the sealing stopper, and wherein the toggle of the sealing stopper is engageable in a shape-adapted opening on an end of the tamper-evident cap.

17. The packaging sleeve of claim 16, wherein at least one axially projecting centering lug is disposed on a lower sleeve part of the tamper-evident cap and alignable with an upwardly open latching groove disposed on a periphery of the packaging sleeve, and wherein the tamper-evident cap can be pushed onto the sleeve body only when the sealing stopper is in the sealed rotational position on the sleeve body.

18. The packaging sleeve of claim 17, wherein the lower sleeve part of the tamper-evident cap is configured as a radially elastically expandable latching collar comprising inclined inlet bevels, wherein the latching collar can be snapped on over an annular collar of the sleeve body in a radially expandable manner.

19. The packaging sleeve of claim 16, wherein the tamper-evident cap consists of two sleeve parts, wherein the sleeve parts are separable from one other by separation seams and are integrally connected to one another via an annular groove with a reduced cross section, and wherein the sleeve parts can be pulled apart with a pull tab.

20. The packaging sleeve of claim 16, wherein the shape adapted opening comprises either two ribs formed on an inner surface of the end of the tamper-evident cap and configured to accept the toggle of the sealing stopper, or a slot in the end of the tamper-evident cap through which the toggle of the sealing stopper protrudes.

* * * * *